US005358388A

United States Patent [19]

Schutten et al.

[11] Patent Number: 5,358,388

[45] Date of Patent: Oct. 25, 1994

[54] NOISE REDUCTION AT THE SECOND ORDER FREQUENCY

[75] Inventors: Herman P. Schutten; Danny M. Wakefield; Donald R. Zimmerer, all of Eden Prairie, Minn.; David W. Malaney, West Bloomfield, Mich.

[73] Assignee: Eaton Corporation, Cleveland, Ohio

[21] Appl. No.: 187,564

[22] Filed: Jan. 27, 1994

[51] Int. Cl.[5] ..... F04B 1/12; F01B 3/00

[52] U.S. Cl. ..... 417/269; 91/478; 91/499

[58] Field of Search ..... 417/269; 91/476, 478, 91/499

[56] References Cited

U.S. PATENT DOCUMENTS

| | | | |
|---|---|---|---|
| 2,288,768 | 7/1942 | Zimmermann . | |
| 2,661,695 | 12/1953 | Ferris . | |
| 2,963,983 | 12/1960 | Wiggermann | 91/478 |
| 3,274,897 | 9/1966 | Reinke . | |
| 3,439,766 | 4/1969 | Dence et al. | 91/499 |
| 4,489,642 | 12/1984 | Westveer | 91/499 |
| 4,550,645 | 11/1985 | Beck, Jr. | 91/499 |
| 5,086,689 | 2/1992 | Masuda | 417/269 |

*Primary Examiner*—Richard A. Bertsch
*Assistant Examiner*—Michael I. Kocharov
*Attorney, Agent, or Firm*—L. J. Kasper

[57] ABSTRACT

A rotary pump (10) is disclosed of the type including a rotating cylinder block (25) defining a plurality of cylinders (27), each defining an imaginary axis (a), which are uniformly spaced about an axis of rotation (A) of the cylinder block. A piston (29) is disposed for reciprocation within each cylinder (27) as the cylinder block rotates. The housing defines a fluid inlet (43) and a fluid outlet (45). In open communication with each cylinder (27) is a cylinder port (47), disposed for serial communication with the fluid inlet and fluid outlet as the cylinder block (25) rotates. Each cylinder port (47) defines a leading edge (L) which are disposed randomly relative to their respective imaginary axis (a). As a result, the timing of communication between the leading edges of the cylinder ports (47) and the fluid inlet and fluid outlet comprise a non-repetitive pattern, thus substantially reducing the sound level at the second fundamental frequency of the piston frequency, also substantially improving the quality of the sound during operation of the pump.

9 Claims, 3 Drawing Sheets

FIG. 2
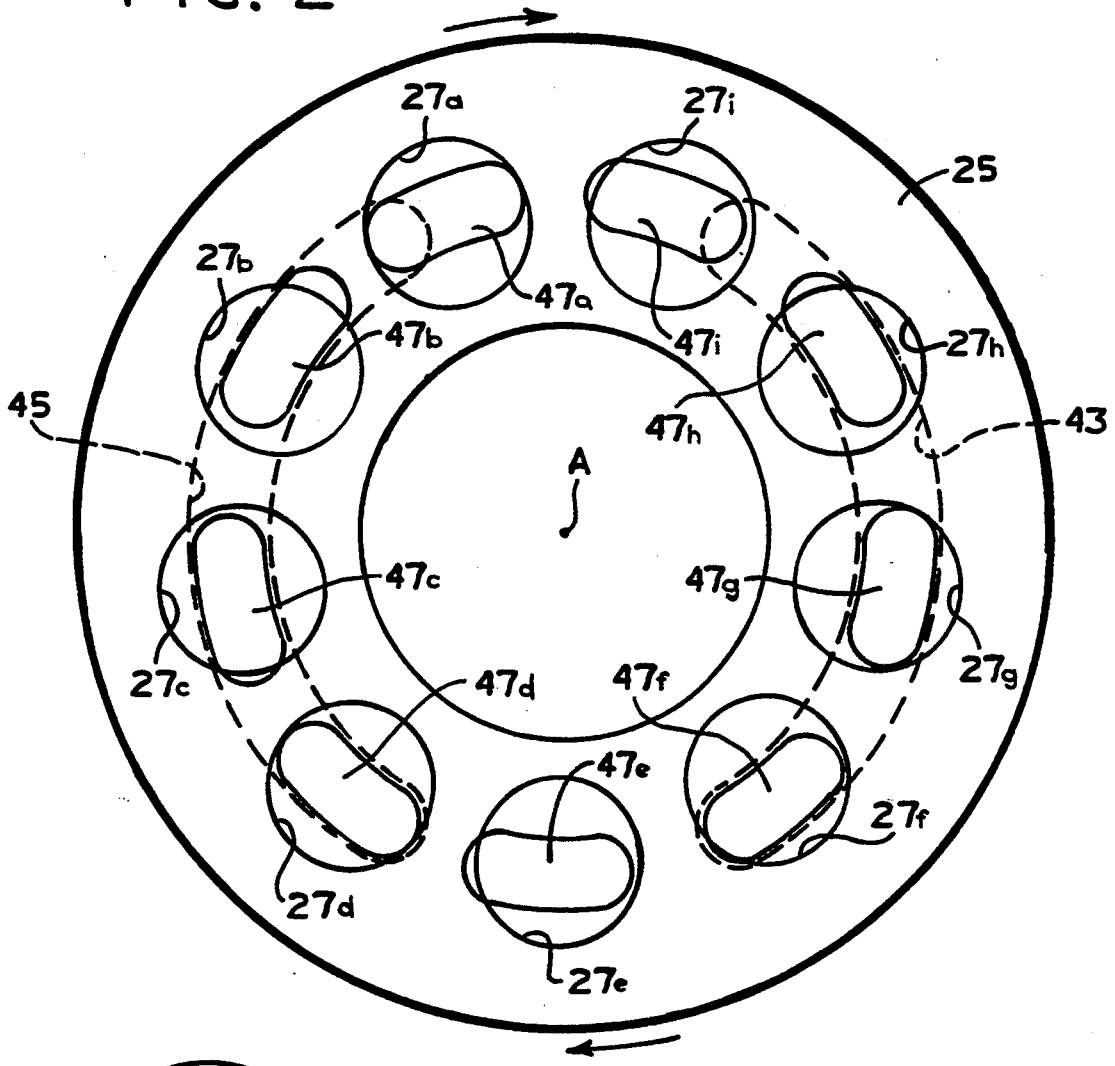
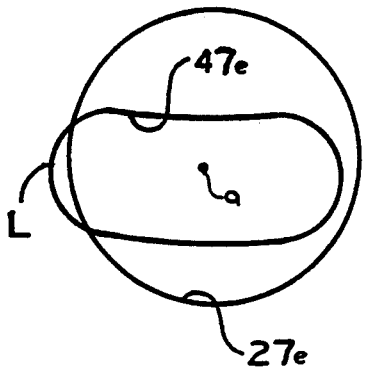
FIG. 2A

NOISE REDUCTION AT THE SECOND ORDER FREQUENCY

BACKGROUND OF THE DISCLOSURE

The present invention relates to rotary fluid pressure pumps and motors, and more particularly, to an arrangement which substantially improves the sound quality of the noise which occurs during the operation of such pumps and motors. It will be understood by those skilled in the art that the present invention may be utilized with various types of pumping and motoring elements. For example, the present invention may be utilized with radial ball or radial piston pumps and motors. However, the invention is especially advantageous when used in an axial piston pump, and will be described in connection therewith.

In a typical axial piston pump, there is a rotating cylinder barrel, which includes a plurality (typically, an odd number) of reciprocating pistons. The pistons engage a cam or swash plate, the position of which may be varied to adjust the displacement of the Dump The end of the cylinder barrel opposite 15 the swash plate is seated against a valve plate which defines a fluid inlet and a fluid outlet. The inlet and outlet are connected, respectively, to the pump inlet port and the pump outlet port defined by the housing.

In a conventional axial piston pump, the cylinders are equally spaced, circumferentially, and at the end of each cylinder, the cylinder barrel defines a cylinder port or kidney port, which provides fluid communication between its respective cylinder and the fluid inlet and fluid outlet in the adjacent valve plate. In a typical, prior art axial piston pump, each of the cylinder barrel kidney ports is the same size, in both the radial and circumferential dimension, with circumferential dimension of each kidney port being substantially equal to the diameter of the cylinder. See, for example, U.S. Pat. No. 3,274,897, which is incorporated herein by reference.

Axial piston pumps of the typo described above have been in widespread commercial use for many years, and have been quite successful commercially. Furthermore, their functional performance has been considered generally quite acceptable. However, with increasing concern regarding environmental issues, such as noise, there has been an increasing effort to reduce the noise produced by vehicle components, such as pumps and motors.

More specifically, axial piston pumps and motors produce a characteristic high frequency noise which is generally considered quite objectionable, and which results partly from the sequential compression and decompression of hydraulic fluid in the piston chamber. One result of such compression and decompression of fluid is vibration of the cam plate (swash plate). It is generally recognized that the compression and decompression phenomenon, and the resulting cam plate vibration, can be controlled by varying valve plate timing, i.e., the initiation of communication between the kidney port and the fluid inlet or fluid outlet in the valve plate. However, varying valve plate timing during operation of an axial piston pump requires rotating the valve plate; while it is under heavy axial loading from the cylinder barrel, which is not very practical.

SUMMARY OF THE INVENTION

Accordingly, it is an object of the present invention to provide an improved hydraulic unit which improves the quality of the sound produced by the hydraulic unit during operation.

It is a more specific object of the present invention to provide such an improved hydraulic unit, which reduces the sound level at the second fundamental frequency of the piston frequency.

It is related object of the present invention to provide an improved hydraulic unit which is capable of breaking up the repetitive nature or pattern of the kidney-to-inlet and kidney-to-outlet communication, without substantially reducing the overall efficiency of the hydraulic unit.

The above and other objects of the present invention are accomplished by the provision of a hydraulic unit of the type containing housing means, an input-output shaft rotatably supported relative to the housing means, a cylinder block rotatably disposed within the housing means and operably associated with the input-output shaft for rotation therewith. The cylinder block defines a plurality N of cylinders, each cylinder defining an imaginary axis, and the imaginary axes being circumferentially spaced about an axis of rotation of the cylinder block. A piston member is disposed for reciprocation within each of the cylinders in response to rotation of the cylinder block. The housing means defines an arcuate fluid inlet and an arcuate fluid outlet, and the cylinder block defines a plurality N of cylinder ports, each cylinder port being associated with, and in open fluid communication with, one of the cylinders. Each of the cylinder ports is disposed for serial communication with the fluid inlet and the fluid outlet during rotation of the cylinder block.

The improved hydraulic unit is characterized by each of the cylinder ports defining a leading edge relative to the instantaneous direction of rotation of the cylinder block. The leading edges defined by the cylinder ports are disposed randomly relative to their respective imaginary axes, whereby the timing of communication between the leading edges and the fluid inlet and the fluid outlet comprise a non-repetitive pattern, during each rotation of the cylinder block.

BRIEF DESCRIPTION OF THE DRAWINGS

FIG. 2 is a transverse cross-section, taken on line 2—2 of FIG. 1, and on a somewhat larger scale than FIG. 1, illustrating the kidney port spacing of the present invention, but omitting the input shaft and spring.

FIG. 2A is an enlarged view, similar to FIG. 2, illustrating one cylinder and its kidney port.

DESCRIPTION OF THE PREFERRED EMBODIMENTS

Figure 1:
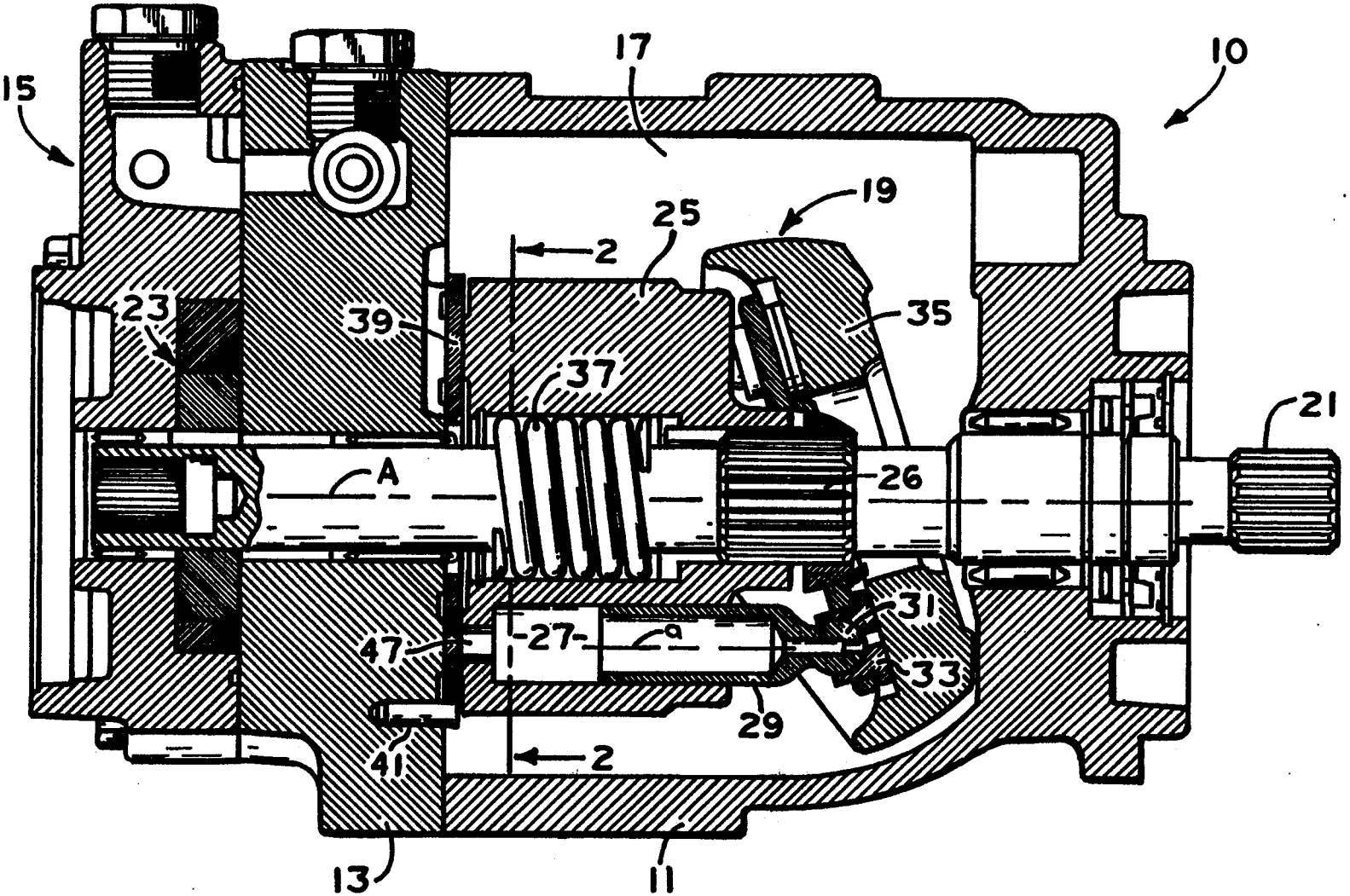
FIG. 1 is an axial cross-section of a conventional axial piston pump of the type with which the present invention may be utilized.

Referring now to the drawings, which are not intended to limit the invention, FIG. 1 is an axial cross-section of an axial piston pump of the type with which the present invention may be utilized. Axial piston pumps of the type to which the invention relates are illustrated and described in great detail in U.S. Pat. No. 4,041,703, assigned to the assignee of the present invention and incorporated herein by reference.

The axial piston pump, generally designated 10, and shown in FIG. 1 includes a main housing 11, to which is attached a back plate assembly 13. Disposed to the rearward end (left end in FIG. 1) of the back plate 13 is a charge pump section, generally designated 15. The main housing 11 cooperates with the back plate 13 to define a pumping chamber 17, within which is disposed a rotating group (pumping element), generally designated 19.

The rotating group 19 receives input torque from an input shaft 21, which extends through substantially the entire axial length of the pump. The input shaft is suitably supported for rotation relative to the main housing 11, the backplate 13, and the charge pump section 15 by various bearing sets, which are not an essential feature of the invention, and will not be described further herein. At the rearward end of the input shaft 21, and within the charge pump section 15, the input shaft 21 is in driving engagement with a rotor element of a charge pump 23, in a manner, and for a purpose which is well understood by those skilled in the art.

Disposed within the pumping chamber 17, the input shaft 21 is surrounded by the rotating group 19. The rotating group 19 comprises a cylinder barrel 25, which defines a plurality of axially-oriented cylinders 27. In the subject embodiment, and as may be seen in FIG. 2, there are nine of the cylinders 27. Disposed within each cylinder is an axially reciprocable piston member 29. Each piston 29 includes a generally spherical head which is pivotally received by a slipper member 33. The slipper members 33 ride on the surface of a trunnion-mounted swash plate 35, as the cylinder barrel 25 rotates relative to the rotationally stationary swash plate 35. Although the swash plate 35 does not rotate about the axis of rotation A of the input shaft 21, it is well known to those skilled in the art that the swash plate 35 may pivot or tilt about a transverse axis in the case of a variable displacement pump or motor.

The cylinder barrel 25 is biased axially, by means of a spring 37, toward fluid tight engagement with a valve plate 39, which is fixed to be non-rotatable relative the housing 11 and back plate 13 by means of a pin 41. As is well known from above-incorporated U.S. Pat. No. 3,274,897, the valve plate 39 defines a fluid inlet 43 and a fluid outlet 45 (shown only in FIG. 2, and there, only in dashed lines).

Referring now to FIG. 2, in conjunction with FIG. 1, at the rearward end of each of the cylinders 27 (left end in FIG. 1), the cylinder barrel 25 defines a kidney port (or cylinder port), generically bearing the reference numeral 47 in FIG. 1. However, it may be seen that in FIG. 2, the cylinders bear reference numerals **27*a* through 27*i*, and the respective kidney ports bear reference numerals 47*a* through 47*i***, for reasons which will be described subsequently.

Referring now primarily to FIG. 2, the general operation of the pump will be described. As the input shaft 21 rotates clockwise (see arrows in FIG. 2), each of the cylinders 27 and kidney ports 47 approaches a top dead center position (which the cylinder **27*a* is approaching in FIG. 2). As each cylinder passes the top dead center position, it begins to communicate with the fluid inlet 43 (as the kidney port 47*i* has just begun to do in FIG. 2). Although, for purposes of simplicity, the fluid inlet 43 and the fluid outlet 45 are shown in FIG. 2 as each comprising one continuous, arcuate opening, those skilled in the art will understand that, in commercial production, such fluid inlets and fluid outlets may comprise several separate arcuate openings, separated by web portions, primarily to improve the strength and rigidity of the valve plate 39**.

When each kidney port 47 is at the bottom dead center position (the position of kidney port **47*e* in FIG. 2), it has passed out of communication with the fluid inlet 43, and has not yet come into communication with the fluid outlet 45. As the cylinder barrel 25 continues to rotate, each piston 29 moves to the left in FIG. 1, pumping pressurized fluid out of its cylinder 27, through its kidney port 47, and into the fluid outlet 45. In FIG. 2, it may be seen that the kidney port 47*d* is in communication with the fluid outlet 45**.

As was mentioned in the BACKGROUND OF THE DISCLOSURE, one of the disadvantages of hydraulic units such as axial piston pumps has been the noise generated during operation, and more specifically, the quality of the noise, as that will be described subsequently. As background for an understanding of the present invention, certain concepts and terms to be used, related to the phenomenon of noise must be understood, and such concepts and terms will hereinafter be described and defined.

A device such as an axial piston pump has a "fundamental frequency" associated with the noise produced by the pump, the fundamental frequency being defined as the product of the number of pistons, and the speed of rotation of the rotating group (in rpm), divided by a conversion constant 60 (seconds per minute). In the subject embodiment, with nine pistons, and assuming a speed of rotation of 2826 rpm, the fundamental frequency would be:

$$(9\times 2826)\div 60=424\text{Hertz}(Hz).$$

The "second order" frequency is defined simply as twice the fundamental frequency, and therefore, in the example given above, with the pump rotating at 2826 rpm, the second order frequency would be 848 Hz. As will be described subsequently, the improvement of the present invention is concerned primarily with improving the noise and the quality thereof, at the second order of the piston frequency, Referring now briefly to the graph of FIG. 3, which is a spectrum analysis plotting sound level, in dB versus frequency, in Hz. The "noise energy" or "acoustic energy" is merely the integral of (total area under) each of the curves, and represents the total energy being produced in the form of noise.

Referring again primarily to FIG. 2, the present invention will now be described in some detail. As was mentioned in the BACKGROUND OF THE DISCLOSURE, it has been conventional for the cylinders 27 to be uniformly spaced, circumferentially, with each kidney port 47 being of the same size, and being in the same position, both radially and circumferentially, relative to its cylinder. More specifically, each kidney port has typically had a circumferential extent substantially equal to the diameter of the cylinder, such that, for either direction of rotation, the "leading edge" of the kidney port coincides with, or is in a O-lap position relative to the profile of the cylinder 27.

In accordance with one aspect of the present invention, it has been discovered that the conventional, prior art arrangement described above results in an excessive sound level, especially at the second order frequency, as will be described in greater detail subsequently.

Referring still primarily to FIG. 2, it may be seen that, in the preferred embodiment of the present invention, all of the kidney ports 47*a* through 47*i* are the same size as each other, and all are located at the same radius from the axis of rotation A defined by the input shaft 21 and the cylinder barrel 25. However, in accordance with the preferred embodiment, the kidney ports 47*a* through 47*i* do not all have the same circumferential location, relative to their respective cylinders 27*a* through 27*i*. For example, the kidney port 47*a* has a substantially O-lap relationship to its cylinder 27*a*, whereas the succeeding kidney port 47*b* has its leading edge in advance (for the direction of rotation of the cylinder barrel 25 indicated by the arrows in FIG. 2) of its cylinder 27*b*. In other words, the kidney port 47*b* has an overlap relationship to its cylinder 27*b*, in the clockwise direction of rotation. The subsequent kidney port 47*c* has its leading edge following the cylinder 27*c*, and therefore has an underlap relationship to its cylinder 27*c*.

In the subject embodiment, the kidney port 47*d* has substantially a O-lap relationship to its cylinder 27*d*, while the kidney port 47*e* has a slight overlap relationship to its cylinder 27*e*. The kidney port 47*f* has a substantially O-lap relationship to its cylinder 27*f*, followed by the kidney port 47*g*, which has a very slight underlap relationship to its cylinder 27*g*. Subsequently, the kidney ports 47*h* and 47*i* have an underlap relationship to their respective cylinders 27*h* and 27*i*, with both underlaps being greater than that of either of the kidney ports 47*c* and 47*g*, and the underlap of the kidney port 47*h* being somewhat greater than that of the kidney port 47*i*.

It will be understood by those skilled in the art from a reading and understanding of this specification that the pattern of lap conditions described above in connection with the preferred embodiment of FIG. 2 is by way of example only. It is considered preferable, for either direction of rotation, that the leading edge (L) of each kidney port (see FIG. 2A) be disposed at a different distance from an imaginary axis (a) of its cylinder than either of the circumferentially adjacent kidney ports (i.e., the preceding or succeeding kidney port). However, such is not necessarily essential to the invention, and an arrangement wherein a pair of circumferentially adjacent kidney ports were in the same relationship to their respective cylinders could still be within the scope of the invention, as long as the arrangement avoided having an overall repetitive pattern of communication of the leading edge of each kidney port to the fluid inlet and the fluid outlet. In other words, one aspect of the present invention is for the pattern of the kidney port to cylinder locations to "random". As used herein, the term "random" will be understood to mean simply a non-repetitive pattern (i.e., non-repetitive within the group of nine pistons in the pump of the subject embodiment). It is believed that it will be within the ability of those skilled in the art to determine what does or does not constitute "non-repetitive", in part based on the results of testing, in comparison to the conventional, uniform kidney port arrangement.

In evaluating the preferred embodiment of the invention, it was observed that the "quality of sound" was substantially improved by using the random kidney port pattern illustrated in FIG. 2. As used herein, the term "quality of sound" refers not merely to the sound level, in dB(A), or the total sound or acoustic energy, but instead, refers to the level of pitch or tonality of :he sound. Those skilled in the art have observed that a lower level of pitch or tonality translates into sound which is less annoying. From a more quantitative standpoint, it has been found that a reduction in the level of elements of noise which occur at relatively high frequencies is typically considered to be an improvement in the quality of the sound.

Figure 3:
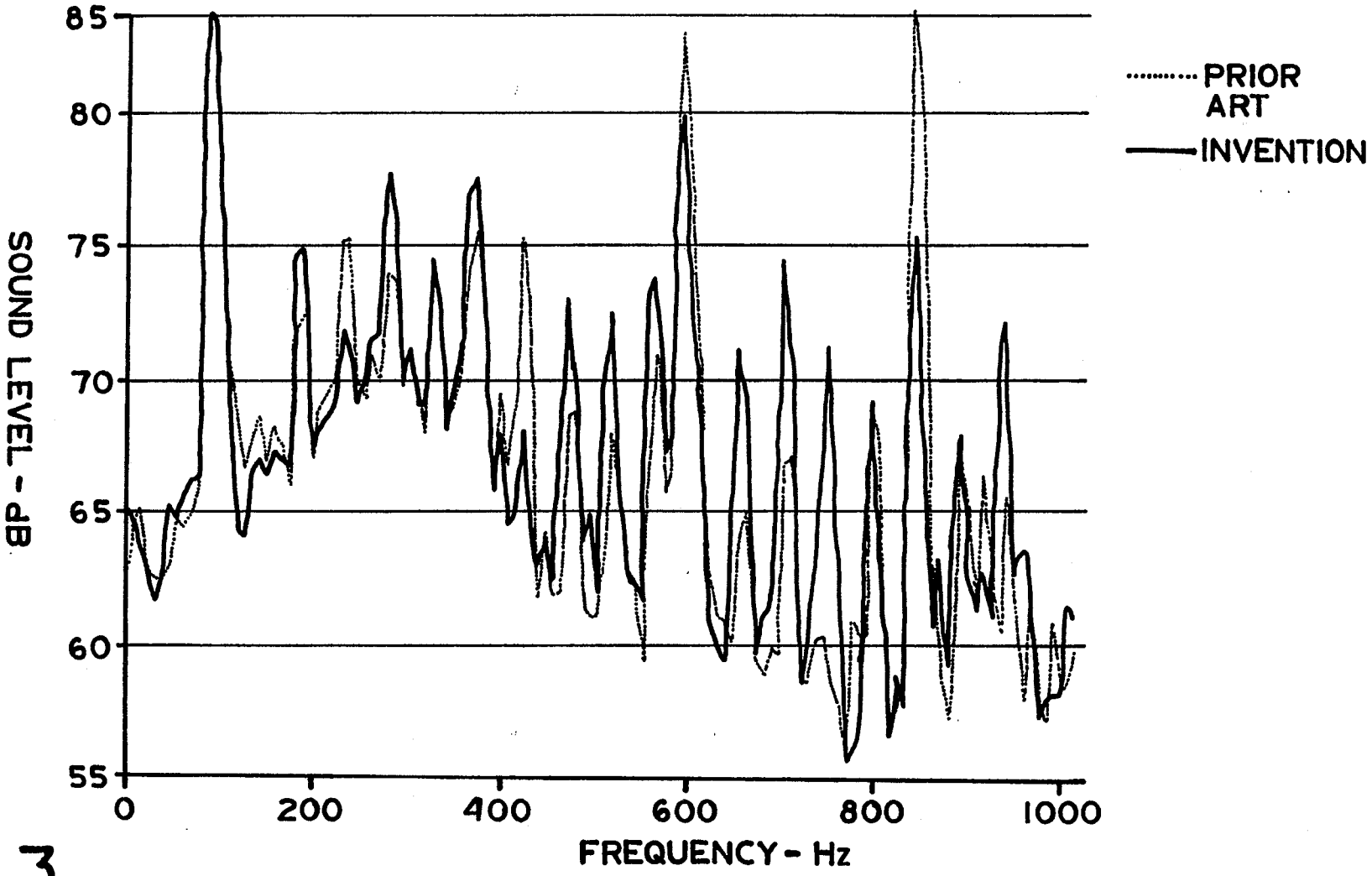
FIG. 3 is a graph of a spectrum analysis of sound level, in dB, as a function of frequency, in Hz.

Referring now primarily to FIG. 3, there is illustrated a graph, comparing the invention to the prior art. The graph of the "PRIOR ART" represents the performance of an axial piston pump, as shown in FIG. 1, utilizing the conventional, prior art uniform kidney port spacing. The curve identified as the "INVENTION" represents the same unit, in which the conventional cylinder barrel was replaced by the cylinder barrel illustrated in FIG. 2, with the random kidney port spacing.

In testing the present invention against the prior art, individual tests were run at 1000 psi, 2000 psi, 3000 psi, 4000 psi, and 4500 psi. The graph of FIG. 3 is for the test run at 3000 psi. Although the invention showed improvement at all pressure levels, 3000 psi was chosen as the most representative test pressure because it most nearly approximates actual "in-the-field" operating conditions. At pressures above 3000 psi, actuation of relief valves may cause noise which interferes with the desired testing, At pressures below 3000 psi, the noise and the quality of the noise are generally not considered as objectionable.

In performing the testing illustrated in the graph of FIG. 3, the pressure was kept nearly constant at 3000 psi, and the oil temperature was maintained nearly constant at 120° F. The results given were for an approximately 10 second test run at 2826 rpm. It should also be noted that, in order to focus solely on the noise created by the pump, the standard manual control linkage was replaced by a rope, thus eliminating one common source of additional noise. In evaluating the "PRIOR ART" unit qualitatively, it was observed that the unit exhibited the characteristic high frequency whine which, as noted previously, is considered objectionable by vehicle operators and vehicle manufacturers alike. As was also noted previously, it is believed that the high frequency whine is largely a function of the spike in the sound level which occurs at the second order frequency, in this particular graph, at 848 Hz. Note that for the "PRIOR ART", the sound level at 848 Hz reached approximately 85 dB, whereas for the invention, at the same frequency, the sound level reached only about 75 dB. As is known to those skilled in the art, the "scale" for sound level is logarithmic, such that, at any given sound pressure level, a reduction of approximately 6 dB would be perceived as only about ½ the noise volume.

Qualitatively, it was observed that the "INVENTION" provided a lower frequency, less objectionable sound, and therefore, an improved sound quality. It should be understood by those skilled in the art that, in comparing the "INVENTION" to the "PRIOR ART", there was not a reduction in the total noise energy or acoustic energy. On the contrary, the total noise energy is the same for both the "PRIOR ART" and the "INVENTION". However, as may be seen in FIG. 3, the reduction of sound level at the second order of frequency (848 Hz) and the slight increase in sound level at certain lower frequencies (in the 150 Hz to about 400 Hz range) indicates that, with the "INVENTION", a substantial amount of the sound energy is "shifted" from the higher frequencies to the lower frequencies, which is what improves the quality of the sound.

Furthermore, on a typical vehicle, the slight increase in the sound level in the lower frequency range means that a greater amount of the sound emanating from the pump will merely blend in with the noise produced by the vehicle engine, which also tends to occur in that same 200 Hz to 400 Hz range.

Alternative Embodiments

Although the random kidney port pattern illustrated in FIG. 2 is considered a preferred embodiment of the invention, it is believed that certain other embodiments would also achieve the desired result. For example, rather than having all of the kidney ports have the same circumferential dimension, the "random" pattern of kidney port leading edge (L) to cylinder axis (a) could be achieved by certain other means. For example, each kidney port could have its center coincident with the imaginary axis (a) of the cylinder, but with each kidney port having a somewhat different circumferential dimension than each of the other kidney ports, or at least a different circumferential dimension than either of the adjacent kidney ports. This arrangement would inherently vary the timing of the communication between the leading edges of the kidney ports and the fluid inlet and fluid outlet, thus avoiding the undesirable repetitive pattern which produces the objectionable high frequency whine.

As another alternative, it would be at least theoretically possible to make the circumferential spacing of the cylinders non-uniform, but then have each kidney port uniformly spaced relative to its cylinder. However, the drawback of such an arrangement is the likelihood that the cylinder barrel would be unbalanced, and thus would require some additional mechanism or manufacturing operation to restore the rotational balance of the cylinder barrel.

In the case of radial ball or radial piston devices, those skilled in the art will understand that the term "uniform" in reference to the cylinders refers to the angular spacing between adjacent cylinders. For example, in a radial piston pump having nine cylinders, the cylinders are considered to be "uniformly circumferentially spaced" about the axis of rotation (A) if the imaginary axis (a) of each cylinder is displaced 40 degrees from that of each adjacent cylinder. Also, in a typical radial ball pump or motor, the rotor rides on a "journal" which typically defines the fluid inlet and fluid outlet (corresponding to the fluid inlet (43) and the fluid outlet (45) of FIG. 2). Any structure which defines a fluid inlet and outlet, such as a journal in a radial ball or piston device, will be understood to be within the scope of the "housing means" for purposes of the appended claims.

It should also be understood by those skilled in the art that the invention is equally applicable to certain pump and motor designs in which the cylinders are neither radial nor purely axial, but instead, the imaginary axis (a) of each cylinder defines a relatively small, acute angle relative to the axis of rotation (A) of the cylinder barrel.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A hydraulic unit of the type including housing means, an input-output shaft rotatably supported relative to said housing means, a cylinder block rotatably disposed within said housing means and operably associated with said input-output shaft for rotation therewith, said cylinder block defining a plurality N of cylinders, each cylinder defining an imaginary axis (a) and said imaginary axes being uniformly circumferentially spaced about an axis of rotation (A) of said cylinder block, and a piston member disposed for reciprocation within each of said cylinders in response to rotation of said cylinder block; said housing means defining a fluid inlet and a fluid outlet, and said cylinder block defining a plurality N of cylinder ports, each cylinder port being associated with, and in open fluid communication with, one of said cylinders; each of said cylinder ports being disposed for serial communication with said fluid inlet and said fluid outlet during rotation of said cylinder block; characterized by:

(a) each of said cylinder ports defining a leading edge (L) relative to the instantaneous direction of rotation of said cylinder block; and (b) each leading edge (L) defined by each cylinder port being disposed at a different distance from its respective imaginary axis (a) than either of the leading edges defined by the circumferentially adjacent cylinder ports.

2. A hydraulic unit as claimed in claim 1, characterized by said imaginary axes (a) of said cylinders being oriented substantially parallel to said axis of rotation (A) of said cylinder block.

3. A hydraulic unit as claimed in claim 1, characterized by said unit further comprising displacement adjustment means operably associated with said piston members for controlling the amount of reciprocation of each piston member and the fluid displacement of said unit.

4. A hydraulic unit of the type including housing means, an input-output shaft rotatably supported relative to said housing means, a cylinder block rotatably disposed within said housing means and operably associated with said input-output shaft for rotation therewith, said cylinder block defining a plurality N of cylinders, each cylinder defining an imaginary axis (a) and said imaginary axes being uniformly circumferentially spaced about an axis of rotation (A) of said cylinder block, and a piston member disposed for reciprocation within each of said cylinders in response to rotation of said cylinder block; said housing means defining a fluid inlet and a fluid outlet, and said cylinder block defining a plurality N of cylinder ports, each cylinder port being associated with, and in open fluid communication with, one of said cylinders; each of said cylinder ports being disposed for serial communication with said fluid inlet and said fluid outlet during rotation of said cylinder block; characterized by:

(a) each of said cylinder ports defining a leading edge (L) relative to the instantaneous direction of rotation of said cylinder block; and (b) the leading edges (L) defined by said cylinder ports being disposed randomly relative to their respective imaginary axes (a), whereby the timing of communication between said leading edges and said fluid inlet and said fluid outlet comprises a non-repetitive pattern,

5. A hydraulic unit as claimed in claim 4, characterized by said imaginary axes (a) of said cylinders being oriented substantially parallel to said axis of rotation (A) of said cylinder block.

6. A hydraulic unit as claimed in claim 4, characterized by said unit further comprising displacement adjustment means operably associated with said piston members for controlling the amount of reciprocation of each piston member and the fluid displacement of said unit.

7. A hydraulic unit of the type including housing means, an input-output shaft rotatably supported relative to said housing means, a cylinder block rotatably disposed within said housing means and operably associated with said input-output shaft for rotation therewith, said cylinder block defining a plurality N of cylinders, each cylinder defining an imaginary axis (a) and said imaginary axes being circumferentially spaced about an axis of rotation (A) of said cylinder block, and a piston member disposed for reciprocation within each of said cylinders in response to rotation of said cylinder block; said housing means defining a fluid inlet and a fluid outlet, and said cylinder block defining a plurality N of cylinder ports, each cylinder port being associated with, and in open fluid communication with, one of said cylinders; each of said cylinder ports being disposed for serial communication with said fluid inlet and said fluid outlet during rotation of said cylinder block; characterized by:

(a) each of said cylinder ports defining a leading edge (L) relative to the instantaneous direction of rotation of said cylinder block;

(b) said imaginary axes (a) of said cylinders defining a first pattern relative to said fluid inlet and said fluid outlet, in response to rotation of said cylinder block;

(c) the leading edges (L) defined by said cylinder ports defining a second pattern relative to said imaginary axes (a); and (d) at least one of said first pattern and said second pattern being non-repetitive within one rotation of said cylinder block, whereby the timing of communication between said leading edges (L) and said fluid inlet and said fluid outlet comprises a non-repetitive pattern.

8. A hydraulic unit as claimed in claim 7, characterized by said first pattern comprising a substantially uniform pattern, and said second pattern comprising said non-repetitive pattern.

9. A hydraulic unit as claimed in claim 7, characterized by said imaginary axis (a) of said cylinders being oriented substantially parallel to said axis of rotation (A) of said cylinder block.

* * * * *